US009374860B2

(12) United States Patent
Kadotani et al.

(10) Patent No.: US 9,374,860 B2
(45) Date of Patent: Jun. 21, 2016

(54) LIGHTING DEVICE

(71) Applicant: Panasonic Corporation, Osaka (JP)

(72) Inventors: Kazuyoshi Kadotani, Osaka (JP); Minoru Maehara, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/497,889

(22) Filed: Sep. 26, 2014

(65) Prior Publication Data

US 2015/0091472 A1 Apr. 2, 2015

(30) Foreign Application Priority Data

Oct. 2, 2013 (JP) ..... 2013-207503

(51) Int. Cl.
*H05B 37/02* (2006.01)
*H05B 33/08* (2006.01)

(52) U.S. Cl.
CPC ..... *H05B 33/0815* (2013.01); *H05B 33/083* (2013.01); *H05B 33/086* (2013.01); *H05B 33/0845* (2013.01); *H05B 33/0857* (2013.01)

(58) Field of Classification Search
USPC ..... 315/291, 307, 224, 246, 247, 312, 315/185 R, 294
See application file for complete search history.

(56) References Cited

U.S. PATENT DOCUMENTS 7,740,371 B1 * 6/2010 Lebens et al. ..... 362/205
2008/0116818 A1 * 5/2008 Shteynberg ..... H05B 33/0815 315/192
2011/0080110 A1 * 4/2011 Nuhfer et al. ..... 315/291
2013/0057163 A1 * 3/2013 Sutardja et al. ..... 315/185 R
2013/0113394 A1 * 5/2013 Ido ..... H05B 33/086 315/297
2013/0207559 A1 * 8/2013 Ferrier ..... H05B 33/083 315/192
2013/0241433 A1 * 9/2013 Ge ..... H05B 33/0815 315/224

FOREIGN PATENT DOCUMENTS

JP 2011-129331 A 6/2011
JP 2011-258517 A 12/2011
JP 2012-221770 A 11/2012
JP 2013-098037 A 5/2013
JP 2013-131393 A 7/2013

* cited by examiner

*Primary Examiner* — Minh D A

(74) *Attorney, Agent, or Firm* — Renner, Otto, Boisselle & Sklar, LLP

(57) ABSTRACT

A lighting device includes a first light source composed of first LEDs each configured to emit light with a first color temperature, a second light source composed of second LEDs each configured to emit light with a second color temperature lower than the first color temperature, a lighting circuit, and a control circuit. The number of second LEDs is less than that of the first LEDs. The lighting circuit is configured to cause the first and second light sources to light on by supplying first and second drive currents to the first and second light sources, respectively. The control circuit is configured to control lighting conditions of the first and second light sources so that: total light intensity of the first light source varies in response to a dimming signal; and total light intensity of the second light source is kept constant independently of the dimming signal.

9 Claims, 6 Drawing Sheets

LIGHTING DEVICE

CROSS-REFERENCE TO RELATED APPLICATIONS

The application is based upon and claims the benefit of priority of Japanese Patent Application No. 2013-207503, filed on Oct. 2, 2013, the entire contents of which are incorporated herein by reference.

TECHNICAL FIELD

The invention relates generally to lighting devices, and more particularly, to a lighting device of which light intensity and light color are variable.

BACKGROUND ART

There has been known a lighting device that includes first light emitting diodes (LEDs) and second LEDs, where each of the first LEDs is configured to emit light with a first correlated color temperature and each of the second LEDs is configured to emit light with a second correlated color temperature (for example, see JP2013-131393A, hereinafter referred to as "Document 1"). The lighting device of Document 1 includes a data storage device that stores, in a data table, values of a first drive current (current supplied to the first LEDs) and a second drive current (current supplied to the second LEDs) which are predefined to be associated with light intensity and correlated color temperatures of the lighting device. The lighting device of Document 1 further includes a first and second drive circuits. The first drive circuit is configured to: generate, when a value of a first drive current is smaller than a predefined specific current value, the first drive current by pulse width modulating a DC current of which magnitude is the specific current value; and generate, when a value of a first drive current is larger than the specific current value, the first drive current of a DC current. Similarly, the second drive circuit is configured to: generate, when a value of a second drive current is smaller than a predefined specific current value, the second drive current by pulse width modulating a DC current of which magnitude is the specific current value; and generate, when a value of a second drive current is larger than the specific current value, the second drive current of a DC current. Further, Document 1 discloses an example in which the number of first LEDs is the same as the number of second LEDs. In this conventional lighting device, by adjusting relative lighting conditions of the first LEDs and the second LEDs, the light color can be changed in a range from warm color to cool color and also the light intensity can be changed with a fixed correlated color temperature.

However, in the lighting device disclosed in Document 1, both the first drive current and the second drive current should be changed in order to change the light intensity and the light color.

SUMMARY

The present invention has been achieved in view of the above circumstances, and an object thereof is to provide a lighting device of which light intensity and light color can be changed with a simple structure. Another object thereof is to provide a lighting device of which the light intensity and the light color can be changed over a wide adjustment range.

A lighting device according to one aspect of the invention includes: a first light source composed of first light emitting diodes; a second light source composed of second light emitting diodes; a lighting circuit; and a control circuit. Each of the first light emitting diodes is configured to emit light with a first color temperature. The number of second light emitting diodes is smaller than the number of first light emitting diodes. Each of the second light emitting diodes is configured to emit light with a second color temperature which is lower than the first color temperature. The lighting circuit is configured to cause the first and second light sources to emit light by supplying first and second drive currents to the first and second light sources, respectively. The control circuit is configured to control the first light source to vary total intensity of light emitted from the first light source in response to variation in a dimming level instructed by a dimming signal; and control the second light source to keep total intensity of light emitted from the second light source constant whether the dimming level is varied or not.

According to the aspect of the invention, the total intensity of light emitted from the second light emitting diodes, each having a lower color temperature, is kept constant, whereas the total intensity of light emitted from the first light emitting diodes, each having a color temperature higher than that of the second light emitting diodes, varies according to the dimming signal. Now, herein, the number of first light emitting diodes is larger than the number of second light emitting diodes. Therefore, the lighting device can change not only the light intensity but also the color temperature by changing the total intensity of light emitted from the first light emitting diodes. In addition, this configuration can change the light intensity and the light color over a wider range in comparison with a case where the number of first light emitting diodes, of which the total light intensity is varied according to the dimming signal, is smaller than the number of second light emitting diodes.

BRIEF DESCRIPTION OF THE DRAWINGS

The figures depict one or more implementation in accordance with the present teaching, by way of example only, not by way of limitations. In the figures, like reference numerals refer to the same or similar elements where:

FIGS. 4A to 4C are diagrams each of which illustrates a relation between light intensity and a color temperature in the lighting device according to the embodiment, in which FIG. 4A shows an example that each of the first LEDs has a color temperature of 6500 K, the number of the first LEDs is 48, each of the second LEDs has a color temperature of 2700 K and the number of the second LEDs is 16, FIG. 4B shows an example that of each of the first LEDs has a color temperature of 5000 K, the number of the first LEDs is 48, each of the second LEDs has a color temperature of 2700 K and the number of the second LEDs is 16, and FIG. 4C shows an example that each of the first LEDs has a color temperature of 5000 K, the number of the first LEDs is 44, each of the second LEDs has a color temperature of 2000 K and the number of the second LEDs is 22;

DETAILED DESCRIPTION

Lighting devices according to an embodiment of the invention will be described with reference to attached FIGS. 1 to 7.

Figure 1:
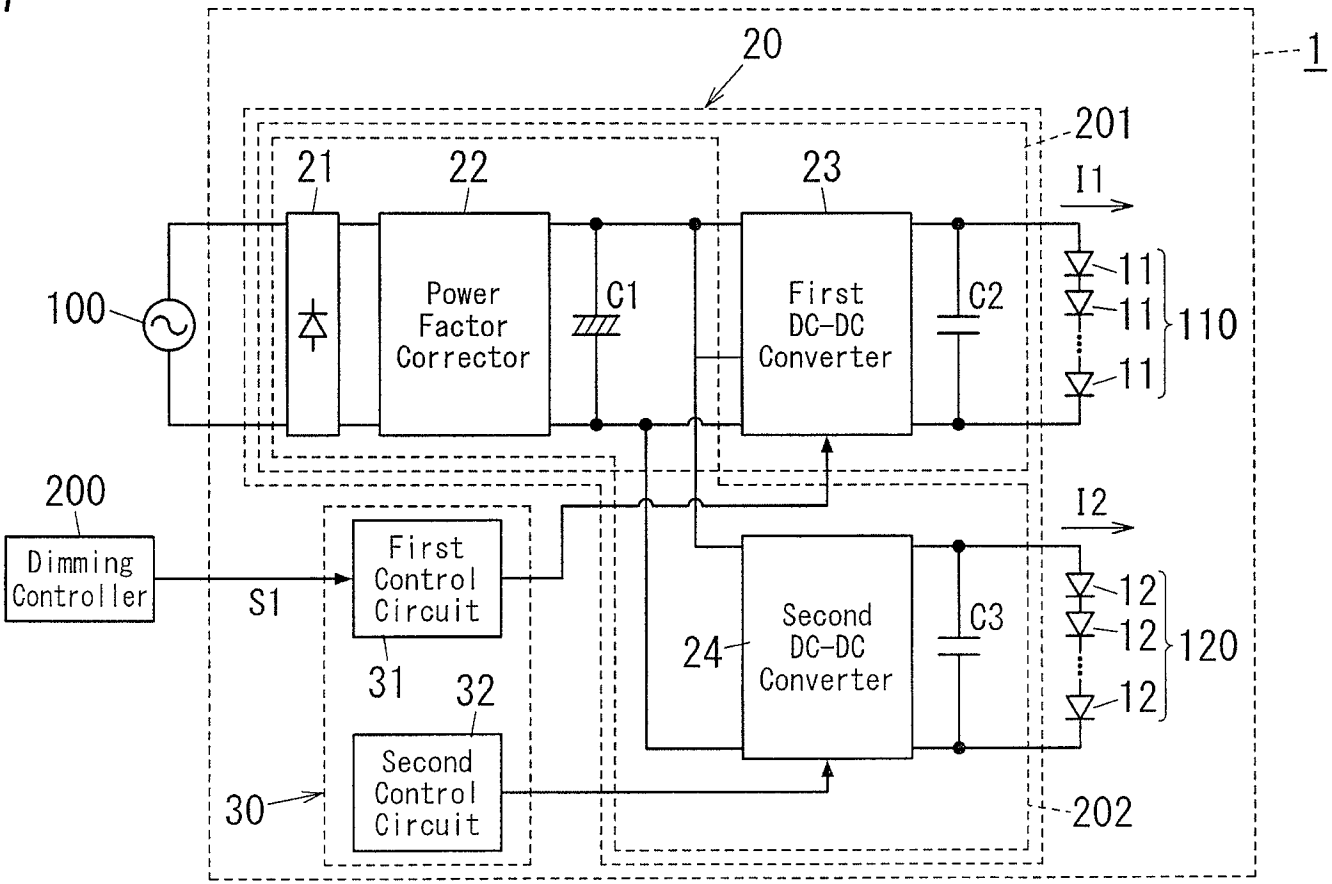
FIG. 1 is a schematic block diagram of a lighting device according to an embodiment.
Figure 2:
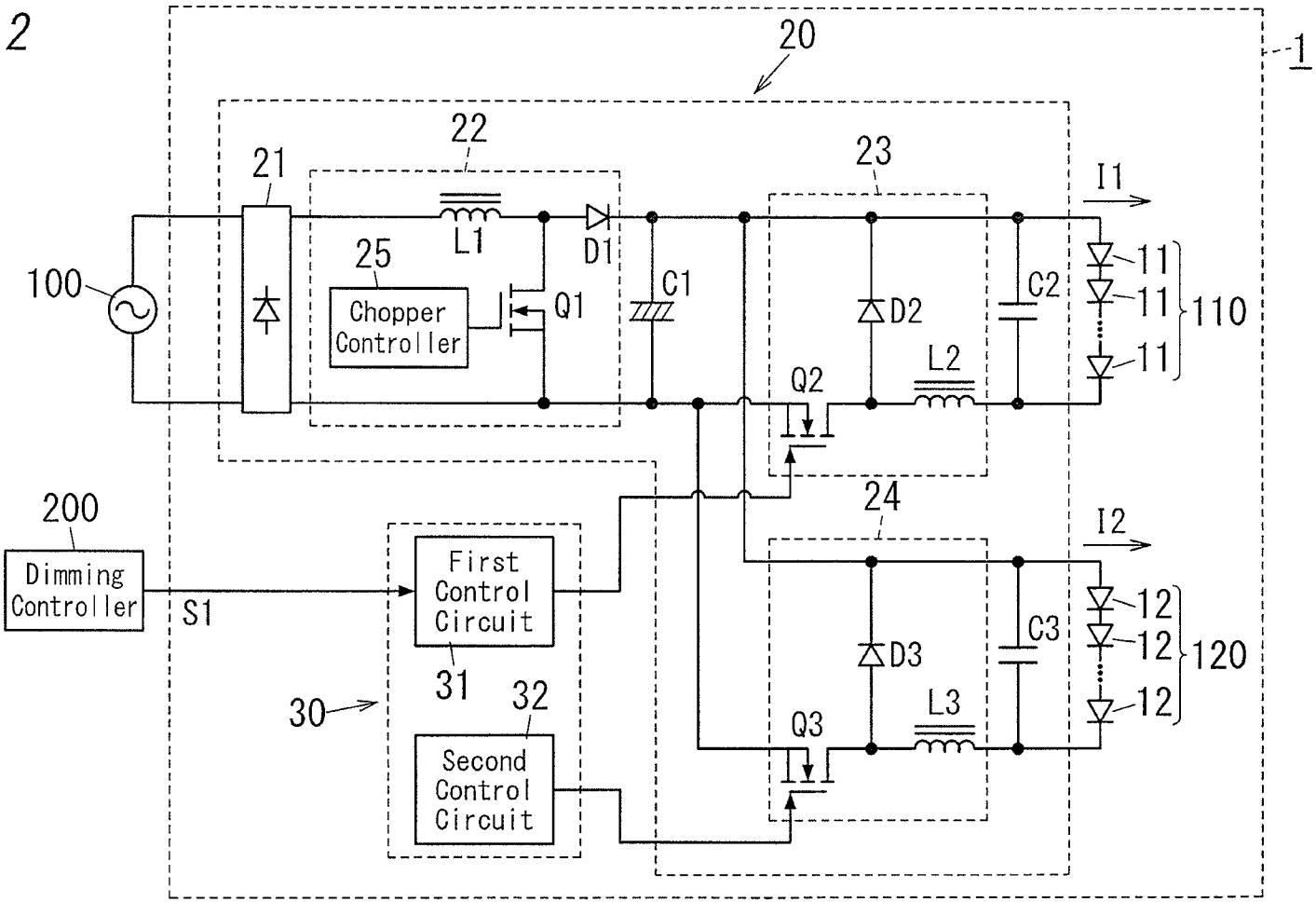
FIG. 2 is a circuit diagram of the lighting device according to the embodiment.

FIG. 1 is a schematic block diagram showing a lighting device 1 according to an embodiment, and FIG. 2 is a diagram showing a circuit configuration used in the lighting device 1 according to the embodiment.

As shown in FIG. 1, the lighting device 1 of the embodiment includes a first light source 110, a second light source 120, a lighting circuit 20 and a control circuit 30. The first light source 110 is composed of first light emitting diodes (first LEDs) 11. The second light source 120 is composed of second light emitting diodes (second LEDs) 12. The lighting circuit 20 and the control circuit 30 constitute a lighting device configured to cause the first light source 110 and the second light source 120 to emit light.

Each of the first LEDs 11 is configured to emit white light with a predetermined first color temperature. For example, each of the first LEDs 11 is configured to emit cool white (bluish white) light with a color temperature of, e.g., 6500 K.

Each of the second LEDs 12 is configured to emit white light with a predetermined second color temperature which is lower than the first color temperature. For example, each of the second LEDs 12 is configured to emit warm white (yellowish to reddish white) light with a color temperature of, e.g., 2700 K.

The number of second LEDs 12 is, hereinafter, represented as "M" (M is an integer of 2 or more) and the number of first LEDs 11 is, hereinafter, represented as "N" (N is an integer of 3 or more). The number of second LEDs 12 and the number of first LEDs 11 are determined so that M is smaller than N (i.e., M<N). For example, in the lighting device 1 of the embodiment, the number of first LEDs 11 is 48 (i.e., N=48), and the number of second LEDs 12 is 16 (i.e., M=16). That is, in the embodiment, the number of first LEDs 11 is three times the number of second LEDs 12 (i.e., N=3M). Note that, the first LEDs 11 are not necessarily to be arranged adjacent to each other in a fixture body of the lighting device 1. The second LEDs 12 are not necessarily to be arranged adjacent to each other in the fixture body. The arrangement of the first LEDs 11 and the second LEDs 12 in the fixture body may properly be selected in accordance with a desired light distribution.

The lighting circuit 20 is configured to cause the first light source 110 and the second light source 120 to light on by supplying a first drive current I1 and a second drive current I2 to the first light source 110 and the second light source 120, respectively.

In the lighting device 1 of the embodiment, the lighting circuit 20 includes a rectifier 21, a power factor corrector 22, a first DC-DC converter 23 and a second DC-DC converter 24. The first DC-DC converter 23 is configured to supply a drive current (the first drive current) I1 to the first light source 110 (the first LEDs 11). The second DC-DC converter 24 is configured to supply a drive current (the second drive current) 12 to the second light source 120 (the second LEDs 12). That is, as shown in FIG. 1, the lighting circuit 20 includes a first lighting circuit 201 configured to supply the first drive current I1 to the first light source 110, and a second lighting circuit 202 configured to supply the second drive current I2 to the second light source 120. The first lighting circuit 201 includes the rectifier 21, the power factor corrector 22 and the first DC-DC converter 23 (and further includes a smoothing capacitor C1 and a capacitor C2). The second lighting circuit 202 includes the rectifier 21, the power factor corrector 22 and the second DC-DC converter 24 (and further includes the smoothing capacitor C1 and a capacitor C3).

An AC power supply (such as a commercial AC power supply) 100 is connected to input ends of the rectifier 21. The rectifier 21 is configured to rectify an AC voltage supplied from the AC power source 100. The rectifier 21 may be a full-wave rectifier composed of, for example, a diode bridge.

As shown in FIG. 2, the power factor corrector 22 is made up of a boost chopper circuit including a switching device Q1 of a field-effect transistor (FET), an inductor L1 and a diode D1. Input ends of the power factor corrector 22 are connected to output ends of the rectifier 21. Output ends of the power factor corrector 22 are connected to the smoothing capacitor C1.

In detail, a first end of the inductor L1 is connected to a positive output terminal of the rectifier 21, and a second end of the inductor L1 is connected to a negative output terminal of the rectifier 21 via the switching device Q1. An anode of the diode D1 is connected to a junction of the inductor L1 and the switching device Q1. The smoothing capacitor C1 is connected between a cathode of the diode D1 and a junction of the negative output terminal of the rectifier 21 and the switching device Q1. The lighting circuit 20 further includes a chopper controller 25. The chopper controller 25 is configured to control switching operation of the switching device Q1. Operations of boost chopper circuits are well known, and therefore are not explained herein in detail.

A voltage across the smoothing capacitor C1 is fed back to the chopper controller 25 as an output voltage of the power factor corrector 22. The chopper controller 25 is configured to control the switching operation of the switching device Q1 so that the power factor corrector 22 outputs a substantially constant DC voltage.

The first DC-DC converter 23 and the second DC-DC converter 24 each are connected in parallel to output ends of the power factor corrector 22 via the smoothing capacitor C1.

The first DC-DC converter 23 is made up of a step-down chopper circuit including a switching device Q2 of an FET, an inductor L2 and a diode D2. Input ends of the first DC-DC converter 23 are connected to the smoothing capacitor C1. Output ends of the first DC-DC converter 23 are connected to the capacitor C2. The first light source 110 is connected between both ends of the capacitor C2. Specifically, the first LEDs 11 are connected in series between both the ends of the capacitor C2.

In detail, a cathode of the diode D2 is connected to a positive end of the smoothing capacitor C1. The switching device Q2 is connected between an anode of the diode D2 and a negative end of the smoothing capacitor C1. A first end of the inductor L2 is connected to between the diode D2 and the switching device Q2; and a second end of the inductor L2 is connected to the cathode of the diode D2 through the capacitor C2. Switching operation of the switching device Q2 is controlled by the control circuit 30. Operations of the step-down chopper circuit are well known, and therefore are not explained herein in detail.

The second DC-DC converter 24 is made up of a step-down chopper circuit including a switching device Q3 of an FET, an inductor L3 and a diode D3. Input ends of the second DC-DC converter 24 are connected to the smoothing capacitor C1. Output ends of the second DC-DC converter 24 are connected to the capacitor C3. The second light source 120 is connected between output ends of the capacitor C3. Specifically, the second LEDs 12 are connected in series between the output ends of the capacitor C3. Switching operation of the switching device Q3 is controlled by the control circuit 30. The second DC-DC converter 24 has the substantially same circuit configuration as the first DC-DC converter 23, and therefore detailed explanation thereof is omitted.

The control circuit 30 includes a first control circuit 31 configured to control an output power of the first DC-DC converter 23 and a second control circuit 32 configured to control an output power of the second DC-DC converter 24. In other words, the control circuit 30 includes the first control circuit 31 configured to control the first lighting circuit 201 and the second control circuit 32 configured to control the second lighting circuit 202.

The control circuit 30 is configured to receive a dimming signal S1 from an external dimming controller 200. The dimming signal S1 is a signal of instructing a dimming level of the lighting device 1. The dimming level indicates light intensity (brightness) of the lighting device 1, and also the dimming level is, for example, substantially proportional to the above light intensity. The control circuit 30 is configured to adjust the light intensity of the first light source 110 and the second light source 120 in a range from a full-lighting state (a high-end dimming level) to a low-end dimming level, according to the dimming level instructed by the dimming signal. The dimming signal S1 instructs the dimming level in a form of, for example, a dimming ratio that is proportional to the light intensity of the lighting device 1.

The first control circuit 31 receives a feedback signal which is, for example, proportional to the magnitude of the drive current I1 supplied to the first light source 110. The first control circuit 31 is configured to control a duty cycle (on-duty) of the switching operation of the switching device Q2 according to both the dimming signal S1 supplied from the dimming controller 200 and the feedback signal indicative of the drive current I1, thereby adjusting the output power of the first DC-DC converter 23. In the embodiment, the first control circuit 31 is configured to control the switching operation of the switching device Q2 so that the magnitude of the drive current I1 is kept at a value corresponding to the dimming ratio instructed by the dimming signal S1.

The second control circuit 32 receives a feedback signal which is, for example, proportional to the magnitude of the drive current I2 supplied to the second light source 120. The second control circuit 32 is configured to control a duty cycle of the switching operation of the switching device Q3 so that total intensity of light emitted from the second LEDs 12 (total light intensity of the second light source 120) is kept constant regardless of the dimming signal S1, thus controlling the output power of the second DC-DC convertor 24. In the embodiment, the second control circuit 32 is configured to control the switching operation of the switching device Q3 so that the magnitude of the drive current I2 is kept constant regardless of the dimming ratio instructed by the dimming signal S1.

Figure 3:
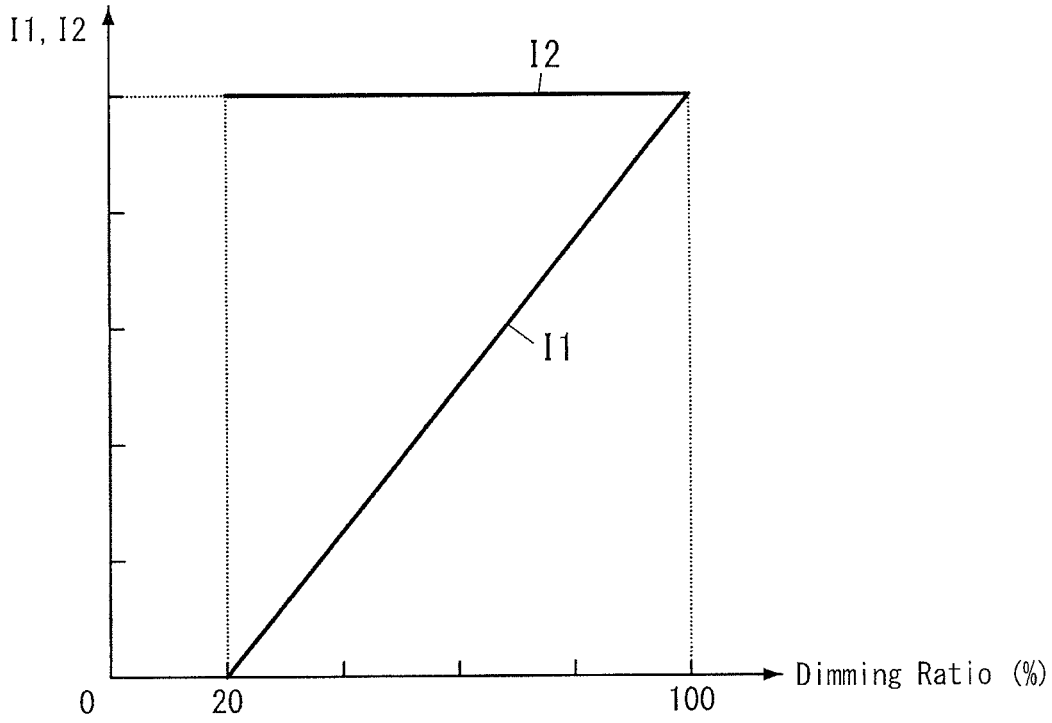
FIG. 3 is a diagram illustrating relations between a dimming ratio instructed by a dimming signal and a drive current supplied to first light emitting diodes (first LEDs) and between the dimming ratio and a drive current supplied to second light emitting diodes (second LEDs) in the lighting device according to the embodiment.

FIG. 3 is a diagram illustrating relations between the dimming ratio (an instruction value) determined by the dimming controller 200 and the drive currents I1 and I2. As shown in FIG. 3, the drive current (the second drive current) I2 supplied from the second DC-DC converter 24 to the second light source 120 (the second LEDs 12) is kept constant regardless of the dimming ratio. Therefore, the total intensity of light emitted from the second LEDs 12 (the total light intensity of the second light source 120) is kept constant regardless of the dimming ratio instructed by the dimming signal S1. On the other hand, the drive current (the first drive current) I1 supplied from the first DC-DC converter 23 to the first light source 110 (the first LEDs 11) decreases as the dimming ratio decreases (i.e., as the brightness decreases). Therefore, the total intensity of light from the first LEDs 11 (the total light intensity of the first light source 110) decreases according to (in linear proportion to) decrease in the dimming ratio instructed by the dimming signal S1. Also as shown in FIG. 3, the first control circuit 31 is configured to control the first DC-DC converter 23 so that the first drive current I1 is equal to the second drive current I2 in a full-lighting state (at an upper limit of a dimming range; e.g., when the dimming ratio is 100%). The first control circuit 31 is also configured to control the first DC-DC converter 23 so that the first drive current I1 is zero at a lower limit of the dimming range (at the low-end dimming level, e.g., when the dimming ratio is 20%).

That is, the first control circuit 31 is configured to control the first lighting circuit 201 so that the first drive current I1 supplied from the first lighting circuit 201 to the first light source 110 decreases in response to decrease in the dimming level (the dimming ratio) instructed by the dimming signal S1. The second control circuit 32 is configured to control the second lighting circuit 202 so that the second drive current I2 supplied from the second lighting circuit 202 to the second light source 120 is kept constant whether the dimming level (the dimming ratio) instructed by the dimming signal S1 is varied or not.

As described above, in the embodiment, the number of first LEDs 11 (represented as N, e.g., N=48) having a higher color temperature is three times the number of second LEDs 12 (represented as M, e.g., M=16) having a lower color temperature. The drive current I2, which is supplied to the second LEDs 12 having a lower color temperature, is kept constant regardless of the dimming ratio. On the other hand, the drive current I1, which is supplied to the first LEDs 11 having a higher color temperature, is controlled so as to: be equal to the drive current I2 in the full-lighting state; decrease as the dimming ratio decreases (i.e., as the brightness decreases); and be zero at the low-end dimming level. Here, assuming that each of first LEDs 11 and each of second LEDs 12 emit the same amounts of light when the same amounts of currents are supplied thereto. Under this assumption, since the number of first LEDs 11 is three times the number of second LEDs 12 (i.e., N=3M) in the embodiment, the light intensity of the lighting device 1 at the low-end dimming level is one-fourth of the light intensity of the lighting device 1 in the full-lighting state. That is, when defining the light intensity of the lighting device 1 in the full-lighting state as 100%, the light intensity thereof at the low-end dimming level is 25%. Note that, in practice, the second LED 12 with a lower color temperature is inferior in luminous efficiency as well as in light intensity than the first LED 11 with a higher color temperature. Therefore, the light intensity of the lighting device 1 at the low-end dimming level is less than 25%.

Figure 4A:
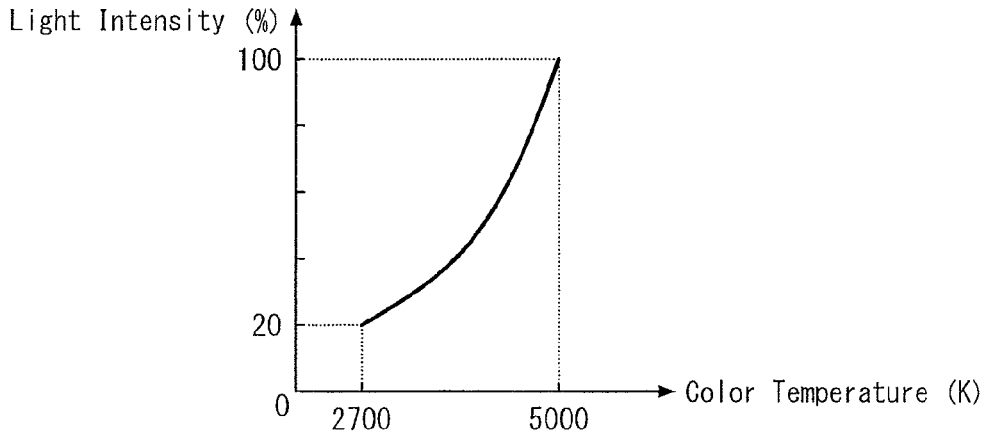

For example, in a case where each of the first LEDs 11 has a color temperature of 6500 K, the number of first LEDs 11 is 48, each of the second LEDs 12 has a color temperature of 2700 K and the number of second LEDs 12 is 16, the measured (actual) light intensity of the lighting device 1 at the low-end dimming level is about 20%. FIG. 4A illustrates a relation between the measured light intensity of the lighting device 1 and the measured color temperature thereof in this case. As seen from FIG. 4A, the color temperature is 2700 K at the low-end dimming level (i.e., when the light intensity is about 20%) and increases as the light intensity increases (i.e., as the brightness increases), and then the color temperature of mixed light of the first LEDs 11 and the second LEDs 12 is 5000 K in the full-lighting state (i.e., when the light intensity is 100%). According to the lighting device 1 of this embodiment, the light intensity can be changed in a range from 20% to 100%, and also the color temperature can be changed from 2700 K to 5000 K while the light intensity is changed from 20% to 100%.

Figure 4B:
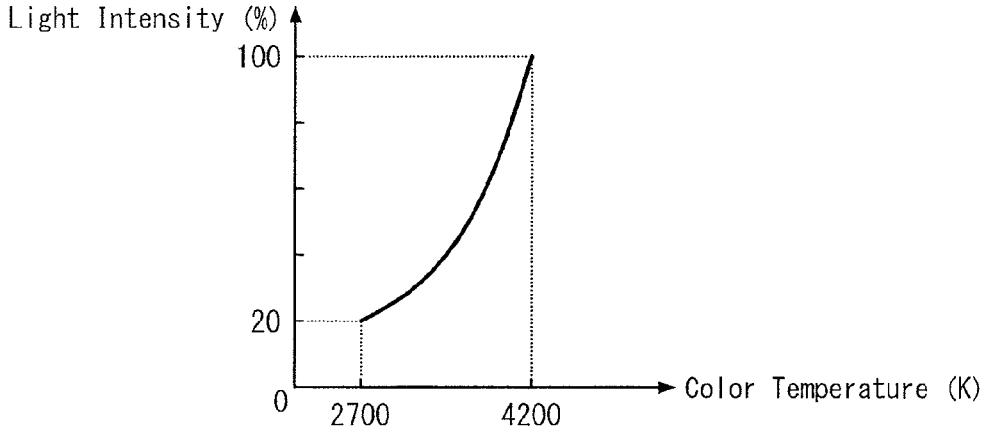

In another case where each of the first LEDs 11 has a color temperature of 5000 K, the number of first LEDs 11 is 48, each of the second LEDs 12 has a color temperature of 2700 K and the number of second LEDs 12 is 16 (i.e., N=3M), the measured (actual) light intensity of the lighting device 1 at the low-end dimming level is about 20%. FIG. 4B illustrates a relation between the measured light intensity of the lighting device 1 and the measured color temperature thereof in this case. As seen from FIG. 4B, the color temperature is 2700 K at the low-end dimming level (i.e., when the light intensity is about 20%) and increases as the light intensity increases (i.e., as the brightness increases), and then the color temperature of mixed light is 4200 K in the full-lighting state (i.e., when the light intensity is 100%). According to the lighting device 1 of this embodiment, the light intensity can be changed in a range from 20% to 100%, and also the color temperature can be changed from 2700 K to 4200 K while the light intensity is changed from 20% to 100%.

In the above described lighting devices 1, the number of first LEDs 11 is three times the number of second LEDs 12 (i.e., N=3M), but the number of first LEDs 11 may be three times or more the number of second LEDs 12 (i.e., N≥3M). With this configuration, the low-end dimming level can be decreased as small as 20%.

Note that, in this embodiment, a desired light intensity in the full-lighting state determines a total of the number of first LEDs 11 and the number of second LEDs 12, and a desired light intensity at the low-end dimming level determines the minimum number of second LEDs 12. Thus, those numbers (the total of the numbers, and the minimum number) determine the maximum of a ratio of the number of first LEDs 11 to the number of second LEDs 12 (N/M).

Note that in the embodiment, the "dimming ratio" set by the dimming controller 200 is correlated with (equal to) the light intensity (total light intensity) of the lighting device 1. For example, when a dimming signal indicative of the dimming ratio of 100% is inputted, the control circuit 30 controls the lighting circuit 20 to turn on the first and second light sources 110 and 120 in the full-lighting state.

In the above described lighting devices 1, the number of first LEDs 11 is three times or more the number of second LEDs 12 (i.e., N≥3M), but the number of first LEDs 11 may be twice or more the number of second LEDs 12 (i.e., N≥2M). Here, assuming that each of first LEDs 11 and each of second LEDs 12 emit the same amounts of light when the same amounts of currents are supplied thereto. Under this assumption, in a case where the number of first LEDs 11 is twice the number of second LEDs 12 (i.e., N=2M), the light intensity of the lighting device 1 at the low-end dimming level is one third of the light intensity thereof in the full-lighting state. That is, when defining the light intensity of the lighting device 1 in the full-lighting state as 100%, the light intensity thereof at the low-end dimming level is 33% in this case. Note that, in practice, the second LED 12 with a lower color temperature is inferior in luminous efficiency as well as in light intensity than the first LED 11 with a higher color temperature. Therefore, the light intensity of the lighting device 1 at the low-end dimming level is less than 33%.

Figure 4C:
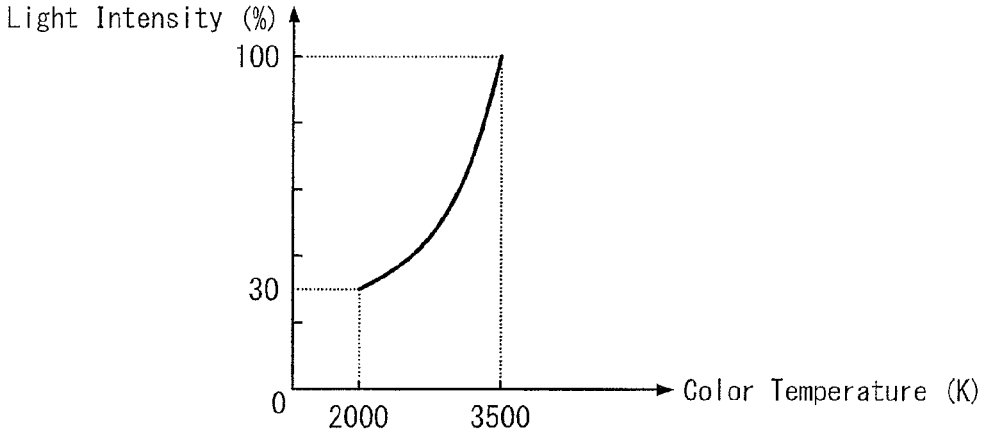

For example, in a case where each of the first LEDs 11 has a color temperature of 5000 K, the number of first LEDs 11 is 44, each of the second LEDs 12 has a color temperature of 2000 K and the number of second LEDs 12 is 22, the measured (actual) light intensity of the lighting device 1 at low-end dimming level is about 30%. FIG. 4C illustrates a relation between the measured light intensity of the lighting device 1 and the measured color temperature thereof in this case. As seen from FIG. 4C, the color temperature is 2000 K at the low-end dimming level (i.e., when the light intensity is about 30%) and increases as the light intensity increases (i.e., as the brightness increases), and then the color temperature of mixed light of the first LEDs 11 and the second LEDs 12 is 3500 K in the full-lighting state (i.e., when the light intensity is 100%). According to the lighting device 1 of this embodiment, the light intensity can be changed in a range from 30% to 100%, and also the color temperature can be changed from 2000 K to 3500 K while the light intensity is changed from 30% to 100%.

The color temperature of the first LED 11 and the number of first LEDs 11, or the color temperature of the second LED 12 and the number of second LEDs 12 are not limited to the above configurations. Theses can be changed according to desired situations.

As described above, the lighting device 1 according to the embodiment includes the first light emitting diodes (the first LEDs) 11, the second light emitting diodes (the second LEDs) 12, the lighting circuit 20 and the control circuit 30. Each of the first LEDs 11 is configured to emit light with the first color temperature. The number of second LEDs 12 is less than the number of first LEDs 11. Each of the second LEDs 12 is configured to emit light with the second color temperature which is lower than the first color temperature. The lighting circuit 20 is configured to cause the first and the second LEDs (11 and 12) to light on by supplying the drive currents to the first and the second LEDs (11 and 12). The control circuit 30 is configured to control the lighting condition of the first LEDs 11 so that the total intensity of light emitted from the first LEDs 11 varies according to the dimming signal S1 supplied from an outside. Besides, the control circuit 30 is configured to control the lighting condition of the second LEDs 12 so that the total intensity of light emitted from the second LEDs 12 is kept constant regardless of the dimming signal S1.

In other words, the lighting device 1 according to the embodiment includes the first light source 110, the second light source 120, the lighting circuit 20 and the control circuit 30. The first light source 110 is composed of the first light emitting diodes (the first LEDs) 11 each of which is configured to emit light with the first color temperature. The second light source 120 is composed of the second light emitting diodes (the second LEDs) 12 each of which is configured to emit light with the second color temperature. The number of second LEDs 12 is less than the number of first LEDs 11. The second color temperature is lower than the first color temperature. The lighting circuit 20 is configured to cause the first and second light sources (110 and 120) to light on by supplying the first and second drive currents (I1 and I2) to the first and second light sources (110 and 120), respectively. The control circuit 30 is configured to control the lighting conditions of the first and second light sources (110 and 120) so that: the total light intensity of the first light source 110 varies in response to variation in the dimming level instructed by the dimming signal S1; and the total light intensity of the second light source 120 is kept constant whether the dimming level instructed by the dimming signal S1 is varied or not.

That is, in the lighting device 1 of the embodiment, the total intensity of light emitted from the second LEDs 12 and having a lower color temperature is kept constant. On the contrary, the total intensity of light emitted from the first LEDs 11 and having a higher color temperature than that of the second LEDs 12, wherein the number of first LEDs 11 is more than that of second LEDs 12, varies according to the dimming signal. It is accordingly possible to change (adjust) the color and intensity over a wide range in comparison with a case where the number of first LEDs 11 is less than the number of second LEDs 12. In addition, the lighting device 1 of the embodiment can change not only the light intensity but also the color temperature by changing the total intensity of light from the first LEDs 11.

In the embodiment, the control circuit 30 is configured to control the lighting circuit 20 so that the first drive current I1 supplied from the lighting circuit 20 to the first light source 110 (the first LEDs 11) is equal to the second drive current I2 supplied from the lighting circuit 20 to the second light source 120 (the second LEDs 12) in the full-lighting state (at the high-end dimming level).

With this configuration, the light intensity per a single first light emitting diode 11 is substantially the same as the light intensity per a single second light emitting diode 12.

In the embodiment, preferably, the number of first LEDs 11 is twice or more the number of second LEDs 12, and the control circuit 30 is configured to control the lighting circuit 20 so that the first drive current I1 supplied from the lighting circuit 20 to the first light source 110 (to all the first LEDs 11) is zero at the low-end dimming level.

With this configuration, if the drive current I1 supplied to the first LEDs 11 is equal to the drive current I2 supplied to the second LEDs 12 in the full-lighting state, the light intensity at the low-end dimming level decreases to one third or less of the light intensity in the full-lighting state, and therefore the low-end dimming level can be reduced to 33% or less.

In the embodiment, preferably, the number of first LEDs 11 is three times or more the number of second LEDs 12, and the control circuit 30 is configured to control the lighting circuit 20 so that the first drive current I1 supplied from the lighting circuit 20 to the first light source 110 (to all the first LEDs 11) is zero at the low-end dimming level.

With this configuration, if the drive current I1 supplied to the first LEDs 11 is equal to the drive current I2 supplied to the second LEDs 12 in the full-lighting state, the light intensity at the low-end dimming level decreases to one-fourth or less of the light intensity in the full-lighting state, and therefore the low-end dimming level can be reduced to 25% or less.

In the lighting device 1 of the embodiment, the control circuit 30 is configured to adjust the first drive current I1 supplied from the lighting circuit 20 to the first light source 110 (the first LEDs 11) so that the total light intensity of the first light source 110 (the total intensity of light emitted from the first LEDs 11) decreases in response to decrease in the dimming level (the dimming ratio) instructed by the dimming signal S1.

In detail, the lighting circuit 20 includes the first lighting circuit 201 configured to supply the first drive current I1 to the first light source 110, and the second lighting circuit 202 configured to supply the second drive current I2 to the second light source 120. The control circuit 30 includes the first control circuit 31 configured to control the first lighting circuit 201, and the second control circuit 32 configured to control the second lighting circuit 202. The first control circuit 31 is configured to control the first lighting circuit 201 so that the first drive current I1 supplied from the first lighting circuit 201 to the first light source 110 decreases in response to decrease in the dimming level instructed by the dimming signal S1. The second control circuit 32 is configured to control the second lighting circuit 202 so that the second drive current I2 supplied from the second lighting circuit 202 to the second light source 120 is kept constant whether the dimming level instructed by the dimming signal S1 is varied or not.

With this configuration, the total intensity of light emitted from the first LEDs 11 can be varied in response to variation in the dimming level (the dimming ratio) instructed by the dimming signal S1.

In the embodiment, the first color temperature is selected from a range of 5000 K to 6500 K, and the second color temperature is selected from a range of 2000 K to 2700 K.

In the above described embodiment, the first control circuit 31 is configured to change the drive current I1 supplied from the first DC-DC converter 23 to the first LEDs 11 in response to variation in the dimming level (the dimming ratio), but may be configured to change the number of first LEDs 11 to be powered in response to variation in the dimming level (the dimming ratio).

Figure 5:
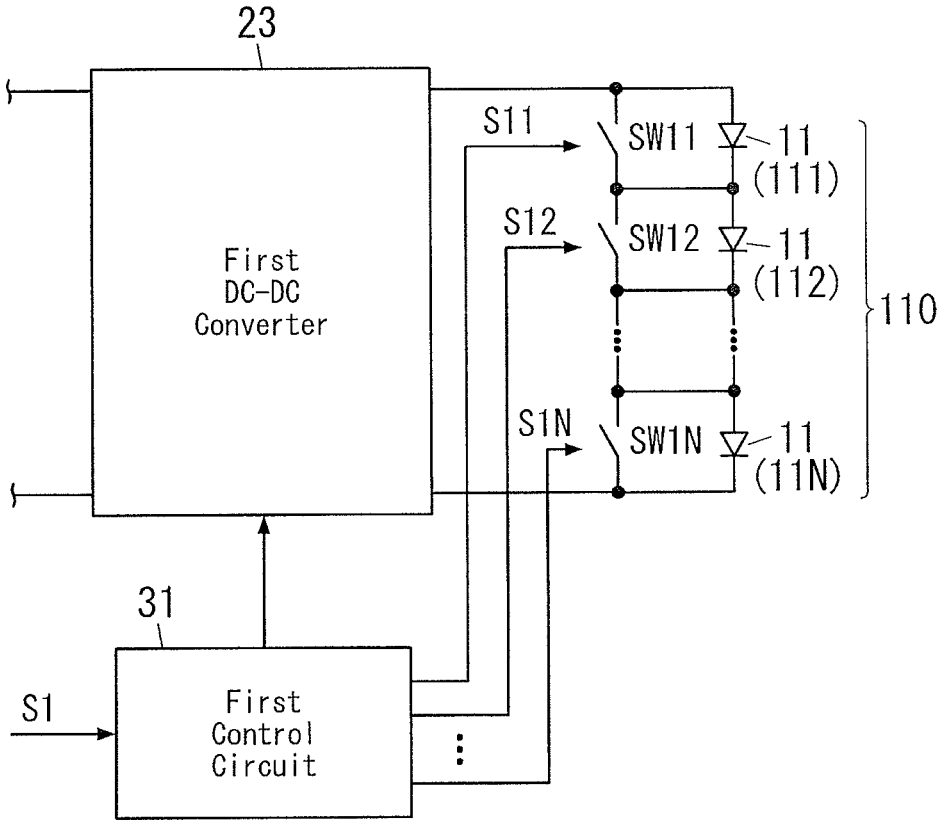
FIG. 5 is a circuit diagram showing a main part of a lighting device according to a modified example of the embodiment.

A lighting device 1 according to this modified example of the embodiment will be explained with reference to FIGS. 5 to 7. FIG. 5 is a circuit diagram showing a main part of the lighting device 1 according to the modified example. As shown in FIG. 5, in the lighting device 1 of this example, the first light source 110 is connected to an output side of a first DC-DC converter 23. The first light source 110 includes first light emitting diodes (first LEDs) 11*n* (n is an integer of 1 to N), where N is the number of first LEDs (N is an integer of 3 or more). The first LEDs 111 to 11N are connected in series. As shown in FIG. 5, the lighting device 1 of the modified example further includes switches SW1*n* (n is an integer of 1 to N), where N is the number of switches SW (the number of switches SW is the same as the number of first LEDs 111 to 11N). The switches SW11 to SW1N are connected in parallel with the first LEDs 111 to 11N, respectively. That is, each of the switches SW1*n* is connected in parallel with the corresponding first LED 11*n*. Each of the switches SW1*n* is turned on and off in accordance with the corresponding control signal S1*n* (n is an integer of 1 to N) which is supplied from a first control circuit 31. When the first control circuit 31 sets a control signal S1*x* (x is an integer selected from a group of 1 to N) in a low level (L level), the corresponding switch SW1*x* is turned off, thereby supplying a first drive current I1 to the corresponding first LED 11*x* connected in parallel with the switch SW1*x* (turned on; powered). When the first control circuit 31 sets the control signal S1*x* in a high level (H level), the corresponding switch SW1*x* is turned on, thereby turning off the corresponding first LED 11*x* connected in parallel with the switch SW1*x*.

In detail, in the lighting device 1, the first control circuit 31 is configured to control an output of the first DC-DC converter 23 so that the first drive current I1 supplied from the first DC-DC converter 23 is kept constant regardless of a dimming signal S1. In a full-lighting state (when a dimming ratio is 100%), the first control circuit 31 sets all of the control signals S11 to S1N in an L level and turns off all of the switches SW11 to SW1N, thereby turning on all of the first LEDs 111 to 11N. When the dimming ratio instructed by the dimming signal S1 is lowered by a predetermined level, the first control circuit 31 switches any control signal S1*x* from an L level to an H level, thereby turning on the corresponding switch SW1*x* to turn off the corresponding first LED 11*x*. The first control circuit 31 increases the number of switches SW1*n* to be turned on every time when the dimming ratio decreases by the predetermined level. At a low-end dimming level, the first control circuit 31 sets all the control signals S11 to S1N in an H level to turn on all the switches SW11 to SW1N, thereby turning off all the first LEDs 111 to 11N.

Structures and operations of a second control circuit 32, a second lighting circuit 202 and a second light source 120 in this example are substantially the same as those in the example of FIG. 1.

Figure 6:
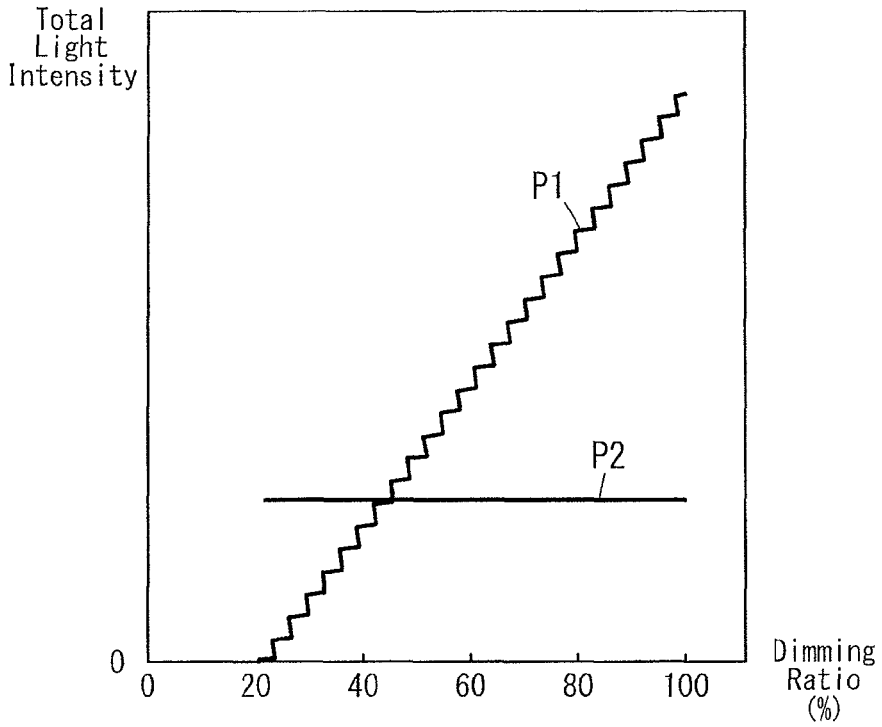
FIG. 6 is a diagram illustrating relations between a dimming ratio instructed by a dimming signal and a total intensity of light emitted from first LEDs and between the dimming ratio and a total intensity of light emitted from second LEDs in the lighting device according to the modified example of the embodiment.
Figure 7:
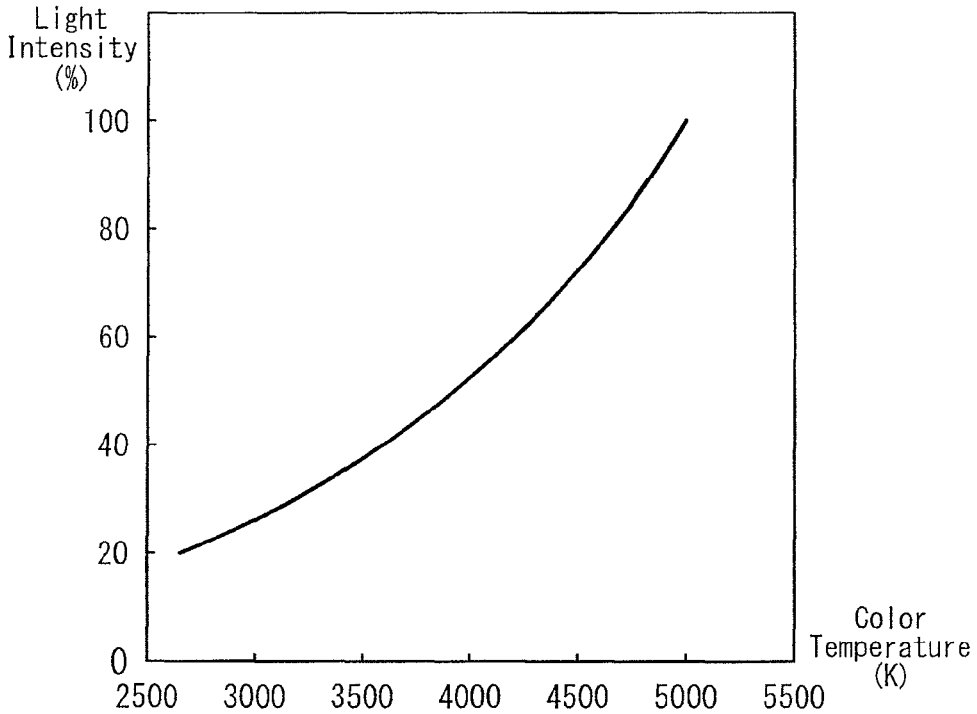
FIG. 7 is a diagram illustrating a relation between light intensity and a color temperature in the lighting device according to the modified example of the embodiment.

FIG. 6 is a diagram illustrating relations between the dimming ratio (an instruction value) determined by a dimming controller 200 and total light intensity P1 of the first LEDs 11 and total light intensity P2 of second LEDs 12. The second control circuit 32 controls a second DC-DC converter 24 so that a second drive current I2 supplied from the second DC-DC converter 24 to the second LEDs 12 is kept constant regardless of the dimming ratio. Therefore, total intensity of light emitted from the second LEDs 12, in which the number of second LEDs 12 is M, (i.e., the total light intensity P2) is kept constant regardless of the dimming ratio. On the other hand, the first control circuit 31 is configured to: turn on all the first LEDs 111 to 11N in the full-light state; and turn off all the first LEDs 111 to 11N at the low-end dimming level. Also, the first control circuit 31 is configured to divide a dimming range ranging from a lower limit to an upper limit (100%) into N equal parts, and thereby the dimming range is divided into N dimming stages. When a dimming ratio, determined by the dimming controller 200, decreases to below the present dimming stage, the first control circuit 31 turns on any switch SW1*x*. Consequently, the number of first LEDs 11 in a light state is reduced by one. When the dimming ratio determined by the dimming controller 200 increases to the next dimming stage, the first control circuit 31 turns off any switch SW1*x*. Consequently, the number of first LEDs 11 in a light state is increased by one. That is, the first control circuit 31 is configured to change the number of first LEDs 11 to be powered according to the dimming ratio determined by the dimming controller 200, thereby changing the total light intensity P1 of the first LEDs 11 substantially linearly according to the dimming ratio.

In this example, the number of first LEDs 11 (represented as N, e.g., N=48) having a higher color temperature is three times the number of second LEDs 12 (represented as M, e.g., M=16) having a lower color temperature. The total intensity of light emitted from the second LEDs 12 and having a lower color temperature is kept constant regardless of the dimming ratio. On the other hand, as for the first LEDs 11 having a higher color temperature, all (N) of them are turned on (powered; lit) in the full-lighting stage, and all (N) of them are turned off at the low-end dimming level. Also, the number of first LEDs 11 to be powered is changed according to the dimming signal supplied from the dimming controller 200.

Here, assuming that each of first LEDs 11 and each of second LEDs 12 emit the same amounts of light when the same amounts of currents are supplied thereto. Under this assumption, since the number of first LEDs 11 is three times the number of second LEDs 12 (i.e., N=3M) in the example, the light intensity of the lighting device 1 at the low-end dimming level is one-fourth of the light intensity thereof in the full-lighting state. That is, when defining the light intensity of the lighting device 1 in the full-lighting state as 100%, the light intensity thereof at the low-end dimming level is 25%. Note that, in practice, the second LED 12 with a lower color temperature is inferior in luminous efficiency as well as in light intensity than the first LED 11 with a higher color temperature. Therefore, the light intensity of the lighting device 1 at the low-end dimming level is less than 25%.

For example, in a case where each of the first LEDs 11 has a color temperature of 6500 K, the number of first LEDs 11 is 48, each of the second LEDs 12 has a color temperature of 2700 K and the number of second LEDs 12 is 16, the measured (actual) light intensity of the lighting device 1 at the low-end dimming level is about 20%. FIG. 7 illustrates a relation between the measured light intensity of the lighting device 1 and the measured color temperature thereof in this case. As seen from FIG. 7, the color temperature is 2700 K at the low-end dimming level (i.e., when the light intensity is about 20%) and increases as the light intensity increases (i.e., as the brightness increases), and then the color temperature is 5000 K in the full-lighting state (i.e., when the light intensity is 100%). According to this lighting device 1, the light intensity can be changed in a range from 20% to 100%, and also the color temperature can be changed from 2700 K to 5000 K while the light intensity is changed from 20% to 100%.

The color temperature of the first LEDs 11 and the number of first LEDs 11, or the color temperature of the second LEDs 12 and the number of second LEDs 12 are not limited to the above configurations, but may be changed according to desired situation. For example, in a case where the number of first LEDs 11 is three times or more the number of second LEDs 12 (i.e., N≥3M), the low-end dimming level may be set to be 25% or less. For example, in a case where the number of first LEDs 11 is twice or more the number of second LEDs 12 (i.e., N≥2M), the low-end dimming level may be set to be 33% or less.

In the example of FIG. 5, the switch SW1*n* is connected in parallel with the first LED 11*n* one by one, but the switch SW1*n* may be connected in parallel with two or more first LEDs 11 connected in series. In this configuration, when a switch SW1*x* is turned off, two or more first LEDs 11 connected in series between both ends of this switch SW1*x* are turned on in a lump; and when the switch SW1*x* is turned on, the two or more first LEDs 11 connected in series between both ends of this switch SW1*x* are turned off in a lump. That is, it is preferable that the lighting device 1 includes switches SW1*n* each of which is connected in parallel with at least one of the first light emitting diodes 11.

As described above, in the lighting device 1 of this modified example, the control circuit 30 is configured to adjust the number of first light emitting diodes 11 to be powered (lit) so that the total light intensity of the first light source 110 (the total intensity of light from the first LEDs 11) decreases in response to decrease in a dimming level (the dimming ratio) instructed by the dimming signal S1.

That is, the lighting device 1 of the modified example further includes the switches SW1*n* (n is an integer of 1 to N) each of which is connected in parallel with at least one of the first LEDs 11. The control circuit 30 is configured to control the switches SW11 to SW1N so that the number of switches SW1*n* to be turned on is increased as the dimming level instructed by the dimming signal S1 decreases, thereby reducing the number of first LEDs 11 to be powered as the dimming level instructed by the dimming signal S1 decreases.

In detail, the lighting circuit 20 includes the first lighting circuit 201 configured to supply the first drive current I1 to the first light source 110, and the second lighting circuit 202 configured to supply the second drive current I2 to the second light source 120. The control circuit 30 includes the first control circuit 31 configured to control the first lighting circuit 201 and the switches SW11 to SW1N, and the second control circuit 32 configured to control the second lighting circuit 202. The first control circuit 31 is configured to control the first lighting circuit 201 so that the first drive current I1 supplied from the first lighting circuit 201 is kept constant whether the dimming level instructed by the dimming signal S1 is varied or not, and also to control the switches SW11 to SW1N so that the number of switches SW1*n* to be turned on is increased as the dimming level instructed by the dimming signal S1 decreases. The second control circuit 32 is configured to control the second lighting circuit 202 so that the second drive current I2 supplied from the second lighting circuit 202 to the second light source 120 is kept constant whether the dimming level instructed by the dimming signal S1 is varied or not.

With this configuration, the total intensity of light from the first LEDs 11 can be varied in response to variation in the dimming level (the dimming ratio) instructed by the dimming signal S1.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device comprising:

a first light source composed of first light emitting diodes, each being configured to emit light with a first color temperature;

a second light source composed of second light emitting diodes, each being configured to emit light with a second color temperature lower than the first color temperature, the number of second light emitting diodes being less than the number of first light emitting diodes;

a lighting circuit configured to cause the first light source and the second light source to light on by supplying a first drive current and a second drive current to the first light source and the second light source, respectively; and a control circuit configured to control lighting conditions of the first light source and the second light source so that: total light intensity of the first light source varies in response to variation in a dimming level instructed by a dimming signal; and total light intensity of the second light source is kept constant regardless of the dimming level, wherein the lighting circuit comprises: a first lighting circuit that comprises a first DC-DC converter and is configured to supply the first drive current to the first light source; and a second lighting circuit that comprises a second DC-DC converter and is configured to supply the second drive current to the second light source, the control circuit comprises: a first control circuit configured to control the first lighting circuit; and a second control circuit configured to control the second lighting circuit, and the first control circuit is supplied with the dimming signal, while the second control circuit is not supplied with the dimming signal, wherein the first color temperature is set in a range of 5000 K to 6500 K, and the second color temperature is set in a range of 2000 K to 2700 K.

2. The lighting device according to claim 1, wherein the control circuit is configured to control the lighting circuit so that the first drive current supplied from the lighting circuit to the first light source is equal to the second drive current supplied from the lighting circuit to the second light source in a full-lighting state.

3. The lighting device according to claim 2, wherein the number of first light emitting diodes is twice or more the number of second light emitting diodes, and the control circuit is configured to control the lighting circuit so that the first drive current supplied from the lighting circuit to the first light source is zero at a low-end dimming level.

4. The lighting device according to claim 2, wherein the number of first light emitting diodes is three times or more the number of second light emitting diodes, and the control circuit is configured to control the lighting circuit so that the first drive current supplied from the lighting circuit to the first light source is zero at a low-end dimming level.

5. The lighting device according to claim 1, wherein the control circuit is configured to adjust the first drive current supplied from the lighting circuit to the first light source so that the total light intensity of the first light source decreases as the dimming level instructed by the dimming signal decreases.

6. The lighting device according to claim 5, wherein the first control circuit is configured to control the first lighting circuit so that the first drive current supplied from the first lighting circuit to the first light source decreases as the dimming level instructed by the dimming signal decreases, and the second control circuit is configured to control the second lighting circuit so that the second drive current supplied from the second lighting circuit to the second light source is kept constant regardless of the dimming level.

7. The lighting device according to claim 1, wherein the control circuit is configured to adjust the number of the first light emitting diodes to be powered so that the total light intensity of the first light source decreases as the dimming level instructed by the dimming signal decreases.

8. The lighting device according to claim 7, further comprising switches each of which is connected in parallel with at least one of the first light emitting diodes, wherein the control circuit is configured to control the switches so that the number of switches to be turned on is increased as the dimming level instructed by the dimming signal decreases, and the number of first light emitting diodes to be powered is reduced as the dimming level instructed by the dimming signal decreases.

9. The lighting device according to claim 8, wherein the first control circuit is configured to control the first lighting circuit so that the first drive current supplied from the first lighting circuit is kept constant regardless of the dimming level, and to control the switches so that the number of switches to be turned on is increased as the dimming level instructed by the dimming signal decreases, and the second control circuit is configured to control the second lighting circuit so that the second drive current supplied from the second lighting circuit to the second light source is kept constant regardless of the dimming level.

* * * * *